United States Patent [19]

Sieffert

[11] 4,396,146

[45] Aug. 2, 1983

[54] COLLAPSIBLE CORRUGATED CONTAINER

[75] Inventor: William G. Sieffert, Joliet, Ill.

[73] Assignee: Champion International Corporation, Stamford, Conn.

[21] Appl. No.: 410,030

[22] Filed: Aug. 20, 1982

Related U.S. Application Data

[63] Continuation of Ser. No. 245,921, Mar. 20, 1981, abandoned.

[51] Int. Cl.[3] ..... B65D 5/48

[52] U.S. Cl. ..... 229/41 R; 229/27

[58] Field of Search ..... 229/27, 28 R, 41 R, 229/41 B

[56] References Cited

U.S. PATENT DOCUMENTS

| | | | |
|---|---|---|---|
| 1,808,922 | 6/1931 | Gallestel | 229/27 |
| 2,825,496 | 3/1958 | Miessler | 229/37 R |
| 3,039,670 | 6/1962 | Hardon | 229/27 |
| 3,047,201 | 7/1962 | Kuckenbrecker | 229/28 R |
| 3,049,279 | 8/1962 | Mairs | 229/27 |
| 3,403,836 | 10/1968 | Farguliar | 229/27 |
| 4,101,052 | 7/1978 | Doner | 229/41 R |
| 4,192,444 | 3/1980 | Garmon | 229/28 R |

FOREIGN PATENT DOCUMENTS

| | | | |
|---|---|---|---|
| 498818 | 2/1951 | Belgium | 229/27 |
| 672035 | 10/1964 | Italy | 229/27 |

*Primary Examiner*—Herbert F. Ross

*Attorney, Agent, or Firm*—Evelyn M. Sommer; William W. Jones; John H. Mulholland

[57] ABSTRACT

A container made from an integral blank in which a solid bottom wall is provided with hingedly connected side walls and ends walls which may be folded normal thereto. The end walls are provided with additional panels which may be placed in surface-to-surface relation with the interior of the side walls and secured thereto in any suitable manner as by any automatic machinery such as a "tray former". A pair of the securement panels from opposite end walls and opposite corners of the box have extensions which may be folded inwardly toward the opposite side wall panel to form a central partition. These extensions are longer than half the transverse distance between the opposite side walls so that portions of the extensions may meet in surface-to-surface relation to form a partition. The blank and therefore the container when formed may be scored so that it may be collapsed in bellows-like fashion with the side walls and a portion of the end wall folded in and the bottom wall folded out to bring the side walls together with the partition sections folded back against the side walls so that the container may be shipped and stored in collapse form. The upper ends of each of the end walls and the side walls may also be provided with closure flaps. Variations of the structure include having the partition sections extending from elements secured to narrower end walls rather than having the partitions extending from wider side walls; and the securement panels may be varied in relative length to provide variations of the position of the partition structure.

1 Claim, 9 Drawing Figures

FIG. 3.
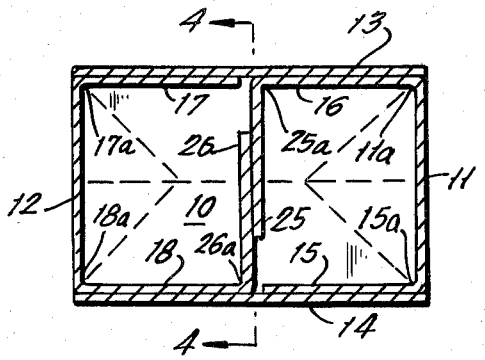
FIG. 4.
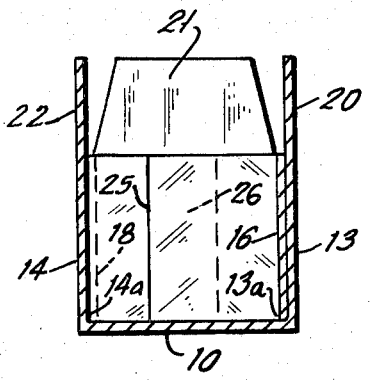
FIG. 6.
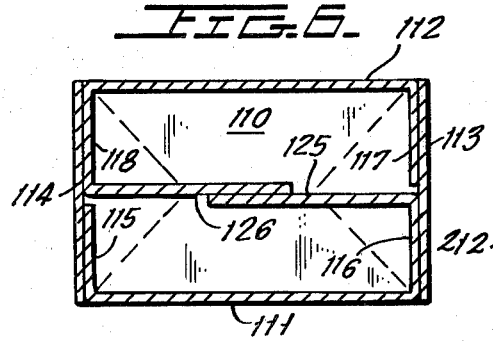
FIG. 7.
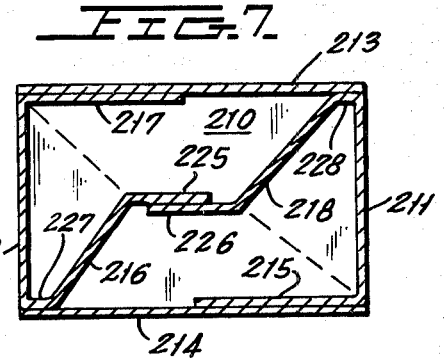
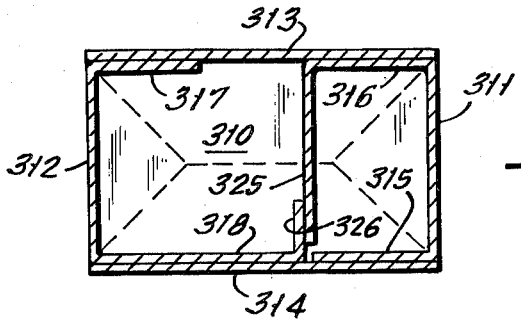
FIG. 8.

COLLAPSIBLE CORRUGATED CONTAINER

This is a continuation of application Ser. No. 245,921, filed Mar. 20, 1981, now abandoned.

The present invention relates to a collapsible one piece fiberboard container made from an integral blank; the container includes an integral center divider and may also have top flaps, closure flaps, reinforcing flaps and a solid seamless bottom.

Basically the container is a tray formed from a single fiberboard sheet cut and scored to provide the desired configuration including center dividers, closure flaps and sealing flaps where desired, and therefore may be formed with presently known "tray former" types of box forming machinery.

Essentially the present invention contemplates the use of a rectangular seamless bottom wall, side walls foldably connected thereto which may be rotated normal to the bottom wall and end walls integrally connected thereto which may also be rotated about fold lines into a position normal to the bottom wall. The end walls or the side walls may have additional flaps extending therefrom foldable into surface-to-surface relation with an angularly adjacent wall and securable thereto in order to maintain the container in erected quadrangular form.

The invention contemplates and has as its primary object the provision of an integral center divider which is provided by extending two diametrically opposite connecting or sealing flaps so that they may be folded inwardly at right angles to the adjacent wall to which they are connected, on score lines located on the said opposite flaps preferably, although not necessarily, approximately half the distance along said adjacent wall so that extensions of said sealing flaps comprise additional center divider flaps which will extend approximately two-thirds the distance toward the opposite wall of the container. By this means, therefore, the center divider flaps extending inwardly from opposite walls approximately two-thirds the distance more or less will meet in overlapping surface-to-surface relation to form a center divider.

Additional score lines may be provided in the bottom wall and a pair of opposite walls normal thereto to provide for means of readily changing the configuration of the erected container from a flat collapsed state to a three-dimensional erected container or back again as the use dictates. Thus, after the container has been formed, it may be collapsed around those additional score lines for shipment or storage and then re-erected around the said additional score lines when it is ready for use.

Each of the side walls and end walls extending normally to the bottom wall and connected together as herein described may also be provided with additional closure panels at the upper edges thereof, so that when the container is erected, closure may be obtained.

The foregoing and many other objects of the present invention will become apparent from the following description and drawings in which:

FIG. 3 is a sectional view taken on line 3—3 of FIG. 2 looking in the direction of the arrows.

FIG. 4 is a sectional view taken on line 4—4 of FIG. 3 looking in the direction of the arrows.

FIGS. 6, 7 and 8 are cross-sectional views corresponding to that of FIG. 3 but showing somewhat modified forms of the structure of the present invention.

Figure 1:
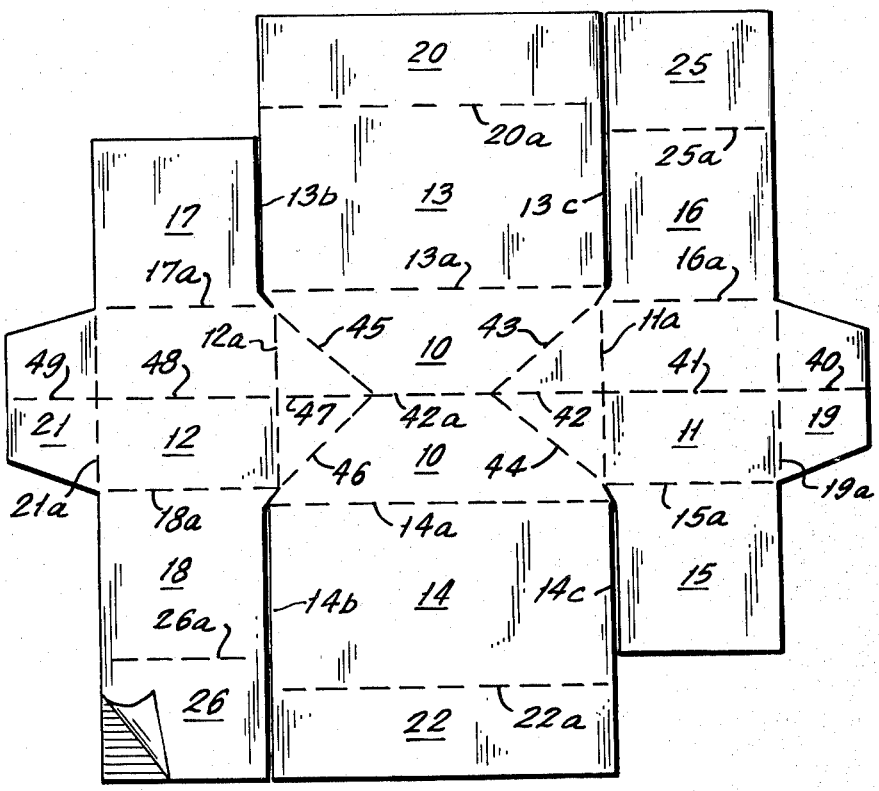
FIG. 1 is a plan view of a blank for forming the partition container of the present invention.

Referring now to FIGS. 1, 2, 3 and 4, the blank of FIG. 1 which is to be formed into the erected container of FIGS. 2, 3, 4 and 5 comprises a bottom wall 10, side walls 13 and 14 connected, respectively, by fold lines **13*a* and 14*a* to the bottom wall 10, and end walls 11 and 12 connected, respectively, by the fold lines 11*a* and 12*a* to the other pair of opposite edges of the bottom wall 10. It will be obvious that when the walls 11, 12, 13 and 14 are folded normal to the wall 10 a box-like structure such as that shown in FIGS. 2, 3, 4 and 5** is created.

Additional securement panels 15 and 16 of end wall 11 may be folded into surface-to-surface relation with the respective side walls 14 and 15 around the fold lines **15*a* and 16*a* and secured adhesively or otherwise in such surface-to-surface relation. The opposite securement panels 17 and 18 of the end wall 12 may also be folded around the fold lines 13*b* and 14*b*, when the box is erected, into surface-to-surface relation with the interior of the other ends of the respective side walls 13 and 14** thereby securing the box in erected position.

The divider is formed by providing an extension 26 from the securement panel 18 on wall 12 of the container and an additional panel 25 connected by fold line **25*a* to the securement panel 16. As will be seen, particularly from FIGS. 2, 3, 4 and 5, the respective additional panels 25 and 26** may be folded inwardly and are dimensioned so that they extend more than half way across the transverse dimension of the container so that they may meet in surface-to-surface relation. The ends of these panels may be secured together in any suitable manner, or left unsecured to be secured together after subsequent erection of the container or left to be maintained in juxtaposition with each other by the internal contents of the container.

In addition, the vertical side walls 13, 14 are respectively provided with cover panels 20 and 22 and the vertical end walls 11 and 12 are, respectively, provided with the cover panels 19 and 21 which may be folded across the top of the container, and, if desired, secured to each other or otherwise closed in any suitable manner.

It will thus be noted that an extension is provided at the end of each securement panel 16 of the end wall 11 and the securement panel 18 of end wall 12 to form the divider panels 25 and 26, and by making the panels 25 and 26 extend for a distance greater than the transverse width of the container between the two walls 13 and 14, the panels 25 and 26 extend at least for some part in surface-to-surface relation to each other.

Figure 9:
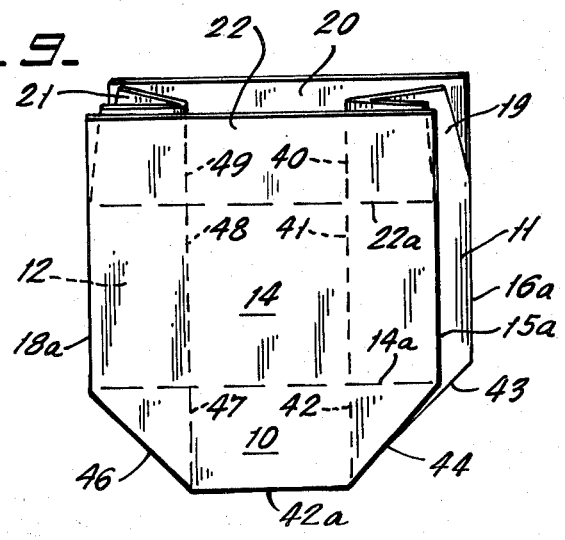
FIG. 9 is a view in perspective of the boxes of FIGS. 2 and 5 collapsed for storage or shipment.

The erected box may be collapsed, if desired, as seen in FIG. 9 on the fold lines 40, 41, 42, 43, 44, 45, 46, 47, 48 and 49. The fold lines 43, 42 and 44 on the one side and 45, 46 and 47 on the other side permit the bottom panel to be collapsed with the section **42*a* of its fold line extending downwardly. The fold line 42 is thus pushed inwardly around the fold lines 43, 44 and the fold line 47** is thus pushed inwardly around the fold lines 45, 46. The fold lines 40, 41 will follow the fold line 42 and the fold lines 48 and 49 will follow the fold line 47, thereby permitting the container to be collapsed in an approximately bellows form with the bottom wall extending half its dimension outwardly from the container and the side wall sections folding inwardly to each other. The container may therefore be stored and shipped flat and re-erected when it is intended to be used.

Since the fold lines must be spaced in a particular way as hereinafter described to permit simplified erection of the container and formation thereof as well as simplified collapse and re-erection thereof, the fold lines and slit lines in the blank are spaced so that the various layers of material which are secured together will not interfere with the collapse. Hence, it will be noted that the fold line 11*a*, which connects the wall 11 to the bottom wall 10, is spaced inwardly from the slit 13*c* which separates the securement panel 16 from the side wall 13 and the slit 14*c* which separates the securement panel 15 from the side wall 14. Similarly on the other side, the fold line 12*a* is spaced inwardly from the respective slits 13*b* and 14*b*.

This inward spacing of the fold line 12*a* toward the center of the blank from the slits 13*b* and 14*b* and the inward spacing of the fold line 11*a* from the slits 13*c* and 14*c* makes it possible when the container is erected to have the securement members 15, 16 on one side and 17, 18 on the other side enter into the container and be secured to the inside of the side wall and still permit the subsequent collapse of the container. The spacing of the fold line from the slits provides room for the additional layers of material.

Figure 5:
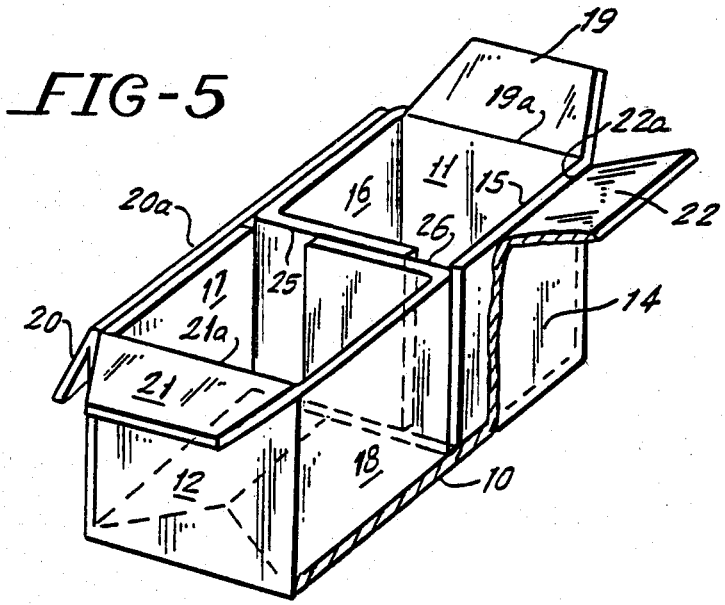
FIG. 5 is a view in perspective corresponding to that of FIG. 2 with one of the side walls broken away further to illustrate the structure of the present invention.

This is also true with respect to the spacing of the fold line 13*a* from the panel fold lines 16*a* and 17*a* on one side, and the spacing of the fold line 14*a* from the fold lines 15*a* and 18*a* of the securement panels on the other side. These folds lines 13*a* and 14*a* for the side panels are spaced outwardly from the fold lines of the securement panels for the end walls so that, again, accommodation will be made for the double and, where necessary, triple thickness of board which is utilized, as seen in FIGS. 3 and 5, so that the container may thereafter be collapsed without destroying or breaking the fold lines.

By this means, therefore, it will be seen that from a single blank a container may be formed by the usual "tray former" apparatus in which a pair of side walls is connected to a pair of end walls by securement panels extending from the end walls into surface-to-surface relation with the side walls.

It will be obvious that although both securement panels for each end are shown as being secured to the end wall at each end, the securement panels may be secured to the side walls.

While the panels have been referred to as side wall panels and end wall panels, it will be obvious, of course, that this is a matter of terminology for the sake of convenience in order to distinguish the two pairs of opposite panels from each other and that the partition panels may as easily extend from side walls as well as end wall. Thus, although panels 15 and 16 by way of example are shown as secured to the end wall 11, panels 16 and 17 may instead be secured to the side wall 13 and panels 15 and 18 may be secured to wall 14. This would entail changing the fold line 15*a*, 16*a*, 17*a* and 18*a* into slots having a width equal to the distance between fold lines 11*a* and 14*a* if extended. What is useful in the operation of the device is that the respective panels 25 and 26, which are to form the partition be sufficiently long so that when they extend transversely across the bottom panel, a portion of each of the two panels 25 and 26 will be in surface-to-surface relationship with each other.

Figure 2:
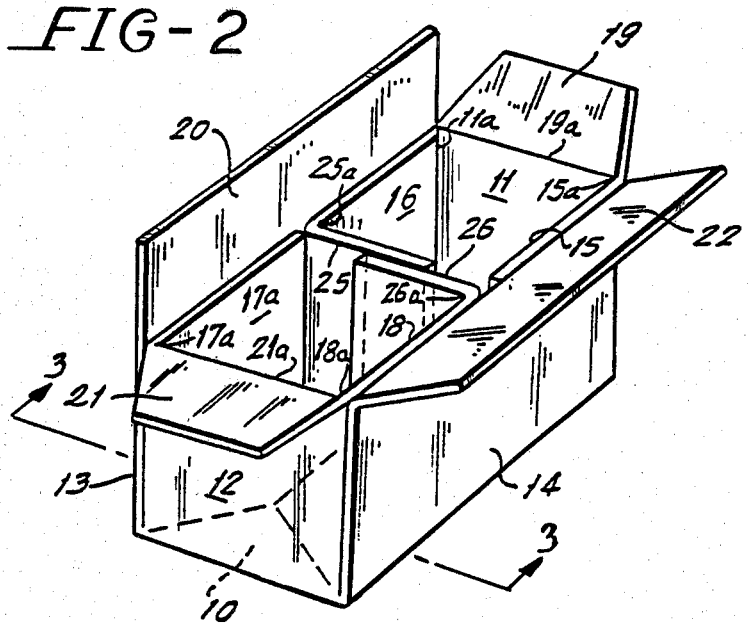
FIG. 2 is a view in perspective showing the partition container of the present invention erected from the blank of FIG. 1 and so arranged that it may readily be collapsed to a position for shipment or storage to be re-erected at the point of use.

The cross-sectional views of FIGS. 3 and 4 have not been separately described because the specific description already given with respect to FIGS. 1, 2 and 5 have necessarily included description of the elements therein contained.

FIG. 5 has been referred to but need not be separately described owing to the fact that FIG. 5 is identical with FIG. 2 except that the side wall 14 and its cover flap 22 have been partially cut away in order to show the arrangement of the securement panel 18 which is secured to the inner surface of the side wall 14 and which is then extended into panel 26 forming part of the interior divider.

FIG. 6 has been included to illustrate the possible variations in dimension as previously described; the reference numbers correspond to the reference numbers of FIGS. 1 to 5 plus 100. In this case the securement panels 115, 116, 117 and 118 extend from the side walls rather than the end walls and are secured in surface-to-surface relation with the end walls. The securement panels 116 and 118 have the extensions 125, 126 to extend inwardly to form the divider.

Instead of going transversely across the bottom wall 110, the dividers will go longitudinally along the longer axis of the bottom wall 110. This will result in some lack of economy in the utilization of the paper board, since the securement panels 116 and 118 and their associated transverse panels 125 and 126, extending from the longer walls 113 and 114 will extend from the blank substantially far beyond even the closure flaps 19 and 21 of the side walls thereby providing substantially more waste material than that shown in the blank of FIG. 1, but nevertheless providing a structure which will operate in substantially the same way. In the case of the structure shown in FIG. 6 also, the fold lines 40 through 49 of FIG. 1 which would be used to collapse this blank instead of running along an axis through the end walls might have to run along an axis through the side walls.

FIG. 7 shows an alternate use of the securement panels in which the securement panels 217 and 215 are utilized in the same way as the corresponding panels 17 and 15 in FIGS. 1 through 5. However, the securement panels 216 and 218 are extended diagonally across the container, as shown in FIG. 7; panel 218 is secured to the side 213 by the small panel 228 and the securement panel 216 is secured to the side wall 214 by the small panel 227. The extension 226 and 225 forming the partitions 226, 225 extend in surface-to-surface relation with each other. In this case collapse as described in connection with FIG. 1 is possible if the total length of sections 227, 216 and 225 of the divider panel (and if the corresponding sections of divider 218) are not longer than the distance between walls 211 and 212. If they are not too long, panels 218 and 216 and their appended sections may be folded back into surface-to-surface relation with the respective walls 213 and 214 in which case the same kind of collapse as previously described may occur. In this case, however, while the erection and creation of the container can take place readily, it may not necessarily be possible to make the same on a "tray former" type of machine, but other types of manufacture may be used. The partition thus created in FIG. 7 may be particularly adapted to particular shapes or formations of objects which are to be included therein; for instance tools having a wider head than the handle which will be held more firmly in place without the utilization of additional structure by this particular type of partition.

In FIG. 8 a further modified form of the structure is provided in which the securement panels 16 and 18 in particular are made of different length, the total of their lengths adding up to the distance between the interior of end walls 311 and 312. This permits the divider formed by panels 325 and 326 to be placed at a point other than midway between the end walls 311, 312.

The primary structure as hereinbefore set forth has been described in connection with FIGS. 1 to 5. FIG. 6 is utilized primarily to illustrate the fact that the dimensional arrangement can be such that the partition structure may extend from panels which are attached to the longer walls which have been called side walls in this description as well as to the shorter walls (as in FIGS. 1 to 5) which have been called end walls.

It will thus be seen that by this means a simplified structure is provided which may readily be erected by presently used automatic machinery such as a so-called "tray former" type of machine into a completed box having integral partitions extending from securement flaps which in turn extend from a pair of opposite walls and secured respectively to angularly adjacent walls. These partition flaps should be long enough so that they overlap each other and may, if desired, be secured together when the box is re-erected from the position of FIG. 9 to the position of FIG. 2.

In the foregoing the present invention has been described solely in connection with illustrative embodiments thereof. Since many variations and modifications of the present invention will now be obvious to those skilled in the art, it is preferred that the scope of the present invention be determined not by the specific disclosures herein contained, but only by the appended claims.

What is claimed is:

1. A reinforced corrugated paperboard container formed from a one-piece blank, said container comprising:

(a) a bottom wall;

(b) a pair of opposed side walls foldably connected to opposite side edges of said bottom wall and extending perpendicularly thereto;

(c) a pair of opposed end walls foldably connected to opposite end edges of said bottom wall and extending perpendicularly thereto;

(d) a securement panel foldably connected to each side edge of said end walls, said securement panels extending perpendicularly to said end walls and being disposed in face-to-face relationship with and secured to the inner surface of said side walls;

(e) a pair of divider extension panels connected by a pair of first fold lines to a first pair of diagonally opposed ones said securement panels, said divider extension panels extending from their respective securement panels across the interior of said container to sub-divide the container into adjacent compartments, and said divider extension panels having overlapping terminal portions; and (f) a second pair of diagonally opposed ones of said securement panels terminating closely adjacent to said first fold lines whereby said side walls are reinforced by said securement panels throughout their entire extent.

* * * * *